US011739554B2

(12) United States Patent
Jones

(10) Patent No.: US 11,739,554 B2
(45) Date of Patent: Aug. 29, 2023

(54) ANCHORING APPARATUS, SYSTEM, AND METHODS OF MAKING AND USING SAME

(71) Applicant: Jeffrey A. Jones, Southbury, CT (US)

(72) Inventor: Jeffrey A. Jones, Southbury, CT (US)

( * ) Notice: Subject to any disclaimer, the term of this patent is extended or adjusted under 35 U.S.C. 154(b) by 14 days.

(21) Appl. No.: 17/233,614

(22) Filed: Apr. 19, 2021

(65) Prior Publication Data

US 2021/0238878 A1 Aug. 5, 2021

Related U.S. Application Data

(63) Continuation-in-part of application No. 16/599,945, filed on Oct. 11, 2019, now Pat. No. 10,982,404.

(51) Int. Cl.
*E04H 12/22* (2006.01)
*E01F 9/673* (2016.01)

(52) U.S. Cl.
CPC ..... *E04H 12/2215* (2013.01); *E01F 9/673* (2016.02)

(58) Field of Classification Search
CPC ... E02D 5/80; E04H 12/2245; E04H 12/2292; G09F 7/18; F16B 2/065
USPC ..... 40/607.05; 248/156
See application file for complete search history.

(56) References Cited

U.S. PATENT DOCUMENTS

| | | | | |
|---|---|---|---|---|
| 819,637 A | | 5/1906 | Diescher | |
| 897,417 A | | 9/1908 | Self | |
| 1,359,492 A | | 11/1920 | Demuth | |
| 3,140,858 A | | 7/1964 | Westphal | |
| 4,133,125 A | | 1/1979 | Lariosa | |
| 4,156,332 A | | 5/1979 | Thompson | |
| 4,326,352 A | | 4/1982 | Barth | |
| 4,910,901 A | * | 3/1990 | Boyar | G09F 7/22 40/607.04 |
| 5,058,337 A | | 10/1991 | O'Connor | |
| 5,088,681 A | | 2/1992 | Procaccianti | |
| 5,230,176 A | * | 7/1993 | Schomaker | G09F 7/18 40/606.19 |
| 5,305,976 A | * | 4/1994 | Blanchard | E04H 12/2215 40/607.08 |

(Continued)

FOREIGN PATENT DOCUMENTS

| | | |
|---|---|---|
| WO | WO2004047599 A1 | 6/2004 |
| WO | WO2012/045066 A2 | 4/2012 |

OTHER PUBLICATIONS

4Ever Products Website, https://www.4everproducts.com/richmond-vinyl-mailbox/1 page, printed Feb. 26, 2020.

(Continued)

*Primary Examiner* — Paola Agudelo
(74) *Attorney, Agent, or Firm* — UConn IP Law Clinic; Juan Gutierrez

(57) ABSTRACT

A system is disclosed herein comprising a stake with a first end portion configured to support a top component, a second end portion configured to be positioned at least partially underground, an anti-twist device formed on the second end portion, and a stabilizing component formed on the second end portion between the anti-twist device and the first end portion. The system also includes a shell with a longitudinal opening configured to receive at least part of the first end portion of the stake. The shell has a lower end that is configured to contact the ground when the system is in use. Corresponding devices and methods also are disclosed.

20 Claims, 11 Drawing Sheets

(56) References Cited

U.S. PATENT DOCUMENTS 5,355,867 A * 10/1994 Hall et al. ..... A47J 33/00 126/30
5,400,535 A * 3/1995 Schomaker ..... G09F 7/18 40/606.19
5,666,940 A 9/1997 Kreiter
5,722,205 A 3/1998 Gannaway
5,749,180 A 5/1998 Jewett
5,819,720 A 10/1998 Schubert
5,903,991 A 5/1999 Sasse
5,906,077 A 5/1999 Andiarena
5,984,587 A 11/1999 Odle
6,113,055 A * 9/2000 Salman ..... E01F 9/635 248/548
6,202,368 B1 3/2001 Wallace, III
6,223,982 B1 5/2001 Dunn
6,578,512 B2 6/2003 Truax
6,640,797 B1 11/2003 Magers
7,089,694 B2 * 8/2006 Allen ..... G09F 15/0037 40/607.04
7,389,603 B1 * 6/2008 Brumfield ..... G09F 7/22 248/370
7,841,117 B2 11/2010 Smith
7,883,070 B2 2/2011 Schroede
8,677,663 B1 * 3/2014 Tyszko ..... G09F 7/18 248/224.7
8,938,900 B1 * 1/2015 Halle ..... G09F 7/18 40/607.09
9,208,706 B1 12/2015 Baron
9,269,282 B1 * 2/2016 Hartman ..... G09F 15/0037
9,406,247 B2 * 8/2016 Disney ..... H04L 67/02
9,741,269 B2 * 8/2017 Ellingson ..... E04H 17/1417
10,208,497 B1 2/2019 Warnes
10,352,013 B2 7/2019 Kelleher
D925,657 S * 7/2021 Hawkins ..... D20/32
2007/0193088 A1 * 8/2007 Lemberger ..... G09F 13/22 40/544
2011/0308990 A1 * 12/2011 Pounders ..... E01F 9/61 362/183
2014/0002031 A1 1/2014 Lee
2014/0345176 A1 * 11/2014 Okert ..... G09F 15/005 40/607.01
2015/0048232 A1 2/2015 Hallauer
2017/0193862 A1 * 7/2017 Warnes ..... G09F 19/228
2018/0155892 A1 6/2018 Kelleher
2018/0315354 A1 11/2018 Woolstenhulme
2019/0063102 A1 2/2019 Writesman

OTHER PUBLICATIONS

Peachtree City Foam Craft Website, http://www.foamcraft.info/models.php 1 page, printed Feb. 26, 2020.

* cited by examiner

ANCHORING APPARATUS, SYSTEM, AND METHODS OF MAKING AND USING SAME

RELATED APPLICATIONS

This application is a continuation-in-part and claims the benefit of U.S. Non-Provisional patent application Ser. No. 16/599,945 with an issue date of Apr. 20, 2021, which will be assigned U.S. Pat. No. 10,982,404, the contents of which are incorporated herein by reference in their entirety.

BACKGROUND

This disclosure relates generally to a ground anchoring apparatus, and more particularly to a ground anchoring apparatus for posts.

Ground anchoring apparatuses for mailboxes, signs, etc. are generally known. An anchoring apparatus has various features including a post. It is problematic when the post lacks stabilization when in use, as is often the case if the post is not mounted in a cement base.

It would be useful to develop a ground anchoring apparatus with improved stability.

SUMMARY

One embodiment described herein is an apparatus comprising a stake with a first end portion configured to support a component, and a second end portion, an anti-twist device formed on the second end portion, and a stabilizing component formed on the second end portion between the anti-twist device and the first end portion. In embodiments the stake has a longitudinal axis, and the anti-twist device extends radially outwardly from the longitudinal axis of the stake.

Another embodiment described herein is a system comprising an apparatus comprising a stake with a first end portion configured to support a component, and a second end portion, an anti-twist device formed on the second end portion, and a stabilizing component formed on the second end portion between the anti-twist device and the first end portion. The system also includes a shell with a longitudinal cavity configured to receive at least a part of the first end portion of the stake, and a top component connected to the first end portion of the stake.

Yet another embodiment described herein is a method of mounting a fixture comprising obtaining an apparatus comprising a stake with a first end portion having a first terminal end including a mounting plate configured to support a component, and a second end portion, an anti-twist device formed on the second end portion, and a stabilizing component formed on the second end portion between the anti-twist device and the first end portion. The method further includes obtaining a shell with a longitudinal cavity configured to receive at least a part of the first end portion of the stake, disposing at least a part of the second end portion of the stake underground, placing the shell over the first end portion of the stake such that the shell contacts the surface of the ground, and mounting the fixture to the mounting plate.

Another embodiment is a system comprising a stake with a first end portion configured to support a top component and a second end portion is configured to be positioned at least partially underground. An anti-twist device is formed on the second end portion. The second end portion also includes a stabilizing component formed on the second end portion between the anti-twist device and the first end portion. In addition, a shell with a longitudinal opening is configured to receive at least a part of the first end portion of the stake. The shell has a first end, and a second end opposite the first end that is configured to contact a surface of the ground when the system is in use.

DETAILED DESCRIPTION

Figure 1:
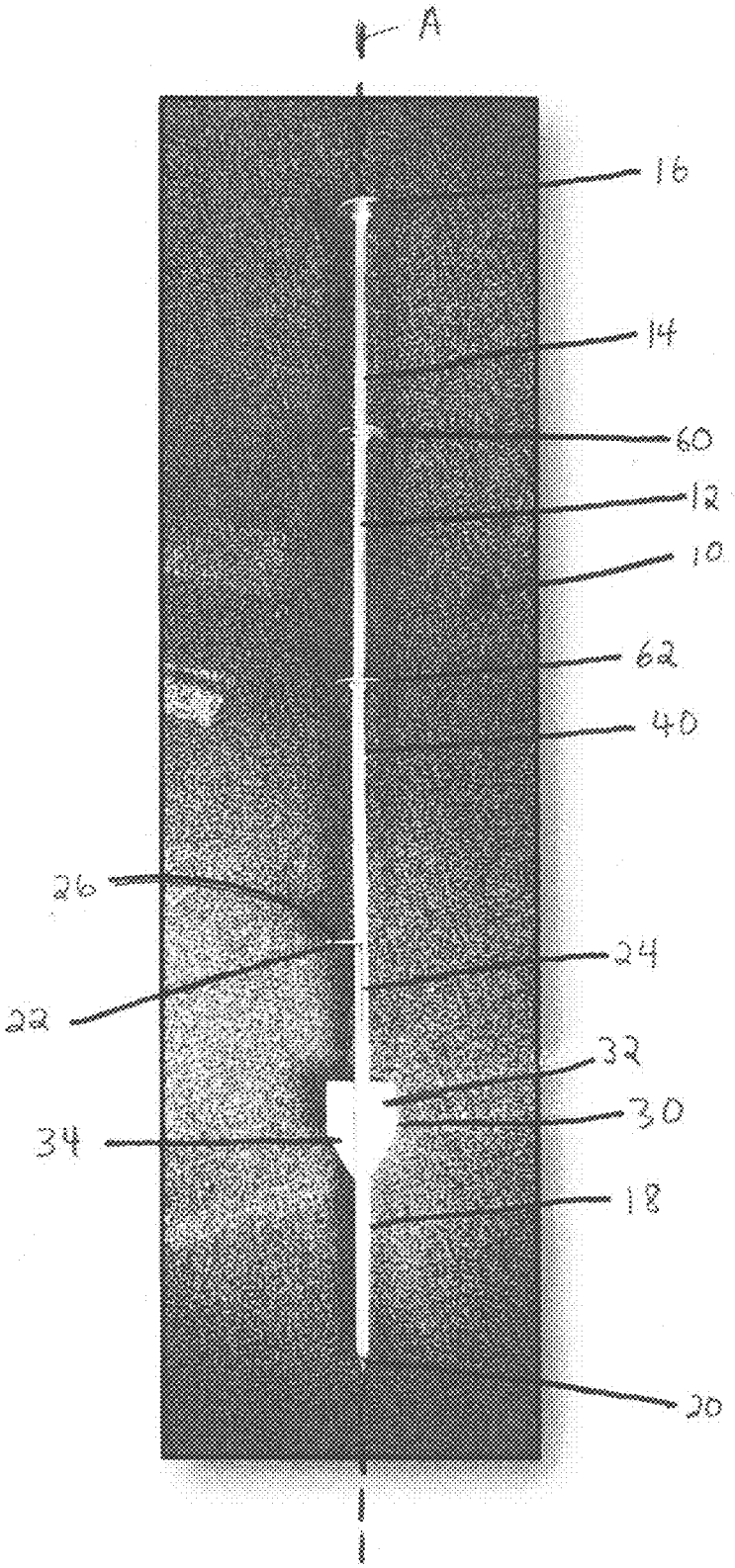
FIG. 1 shows an elevational view of the support apparatus according to a first embodiment.
Figure 2:
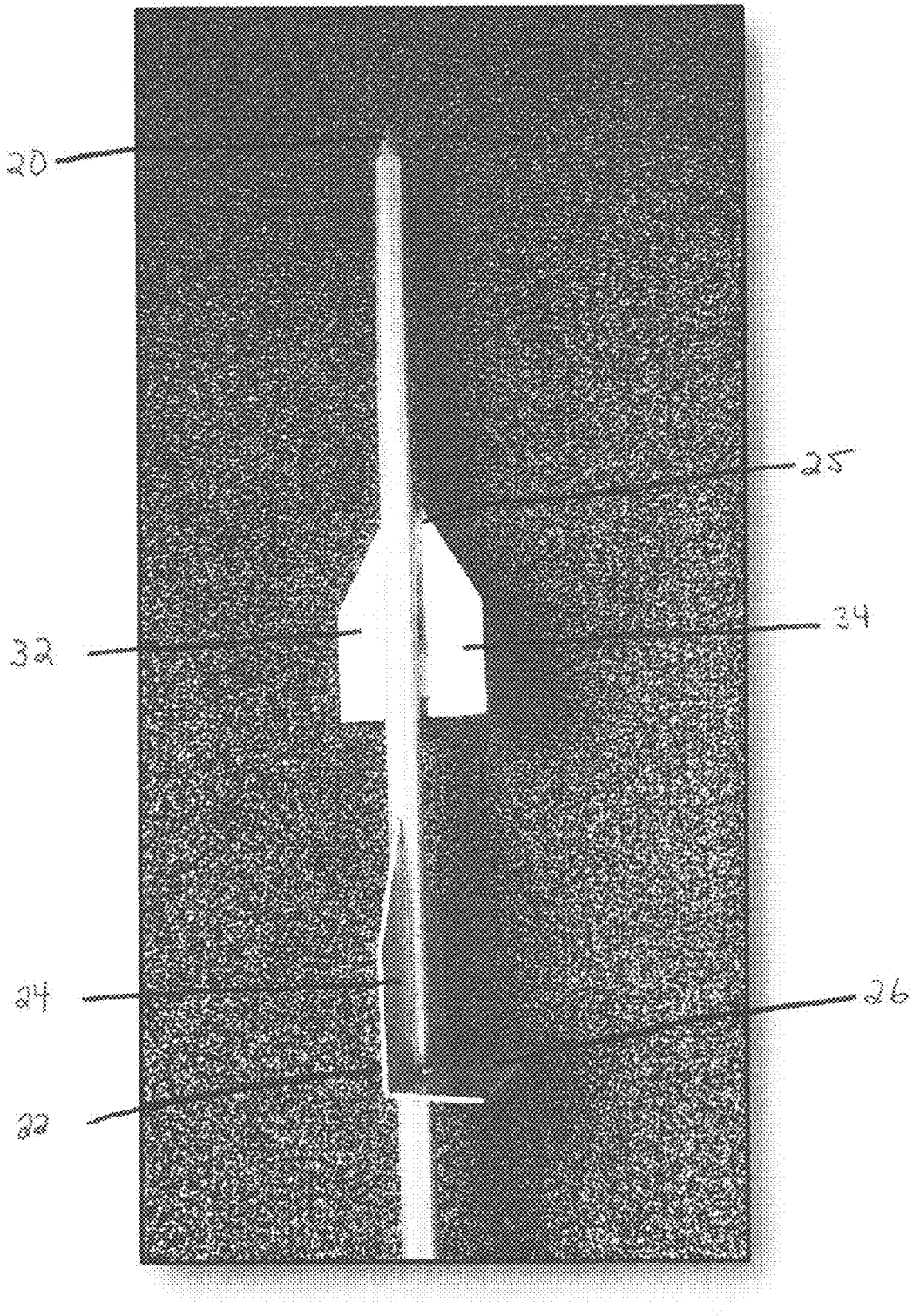
FIG. 2 is a perspective view of the second end portion of the embodiment of FIG. 1 in detail.

The ground anchoring apparatus described herein includes a stake with attachments fixed thereto to anchor and stabilize a column, pillar, post, pole, or other component. The anchoring apparatus penetrates the ground, and the column, pillar, etc. rests on the top surface of the ground. The apparatus secures a mailbox, sign, windmill, tent, statue, fountain, bird bath, bird feeder, display stand, outdoor structure or other device attaching to the top of the ground anchoring apparatus. This device eliminates the need to dig a hold to install a ground-penetrating component, and improves upon the stability of component during and after installation.

Definitions

As used herein, the term "anti-twist device" means a component that prevents the apparatus from twisting after it has been installed in the ground.

As used herein, the term "stabilizing component" means a component that prevents sideways movement of a mounted vertical support.

Referring to the drawings, FIGS. 1-5 show a first embodiment of a support apparatus 10. The support apparatus 10 includes an elongated, rigid stake 12 having a first end portion 14 that includes a mounting component 16 and an opposite, longitudinally spaced second end portion 18 with a pointed terminal end 20 that is configured to be inserted in the ground. A stabilizing component 22 is fixed to the second end portion 18 of the stake 12 at or near the connection to first end portion 14. In some cases, the stabilizing component 22 includes a first section that extends radially outwardly from the stake. In the embodiment shown in FIG. 1, the stabilizing component 22 includes a ground-penetrating portion 24 configured to partially or fully penetrate the ground, and a depth control portion 26 that, in embodiments, is generally perpendicular to the central axis A of the stake 12 and is configured to remain above the ground and prevent the support stake 12 from being pushed too far into the ground. One suitable configuration of the ground-penetrating portion 24 is shown in detail in FIG. 4 and is spade-shaped with the pointed end 25 being configured to enter the ground first. In the embodiment shown in the Figures, the ground-penetrating portion 24 is configured to be disposed underground when the apparatus is in use, and includes opposite first and second blades 27, 29 that are generally coplanar with one another. One suitable configuration of the depth control portion 26 is shown in the figures and includes a generally planar section that extends horizontally across the top surface of the ground when the apparatus is in use.

In the embodiment shown in FIGS. 1-5, an anti-twist device 30 is formed on the stake 12 between the stabilizing component 22 and the pointed terminal end 20. The anti-twist device 30 is configured to prevent rotation of the stake 12 along its it longitudinal axis A after the stake 12 has been inserted in the ground. In the embodiment shown in FIG. 1, the anti-twist device 30 includes a first fin 32 and a second fin 34, both of which are configured to be located underground when the support apparatus 10 is in a mounted position in the ground. In embodiments, the first fin 32 and second fin 34 are coplanar with one another in a plane that is parallel to axis A of the stake 12, and the first fin 32 and second fin 34 extend radially outwardly from the stake 12. In embodiments, the first and second fins are generally coplanar and narrow inwardly in a direction away from the stabilizing component. In some cases, as is shown in FIG. 1, the plane of the first fin 32 and the second fin 34 is perpendicular to the plane of the ground penetrating portion 24 relative to the direction of the axis A of the stake 12, thus providing enhanced stability to the stake 12 after it has been inserted into the ground. In this case, the ground-penetrating portion 24 of the stabilizing component 22 can also contribute to spin resistance of the apparatus 10 after it has been placed in the ground.

Figure 5:
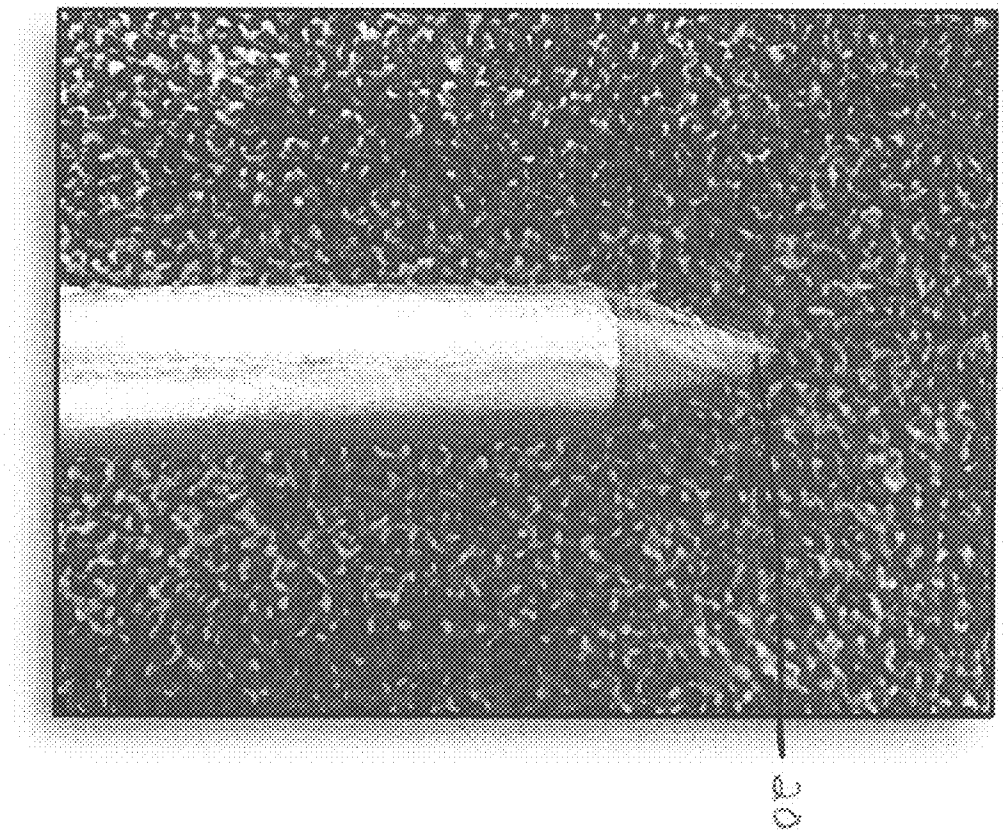
FIG. 5 shows a side view of the terminal end of the second end portion of the embodiment of FIG. 1 in detail.

FIG. 5 shows the details of the pointed terminal end 20 of the stake 12. In the embodiment shown, the point is configured at an angle of about 30-45 degrees. In embodiments, the point is configured at an angle in the range of about the pointed terminal end 20 is configured with a point angle in the range of about 20 to about 80 degrees, or about 30 to about 70 degrees, or about 30 to about 60 degrees.

Referring to FIGS. 1-9, the above-ground portion 40 of the stake 12 is the section of the stake 12 that is configured to be disposed above the ground 33 when the stake 12 is in use. This portion of the stake is surrounded by a shell 44, which may be tubular and may be configured as a column, pillar, post, or pole, as shown in FIGS. 6-9. The shell 44 can be configured to impart an aesthetically pleasing appearance to the system. The shell 44 includes a first end section 46 configured to be positioned around the first end portion of the stake 12, and a second end section 48 configured to rest on the depth control portion 26 and/or the ground when the system is mounted in the ground. The shell has a longitudinal opening 50 with an inner wall 52 extending through most, or all, of the first end section 46, and through to the second end section 48. The longitudinal opening is configured to surround the above-ground portion of the stake 12 and to have direct contact with the outer edge surfaces 57, 59 of first and second centering components 60, 62, respectively, that are disposed along the length of stake 12. In the embodiment of FIG. 1, the first centering component 60 and the second centering component 62 are used, but a great number or a smaller number of centering component can be used depending on the strength of the stake, the weight and balance of the item being supported, etc.

Figure 3:
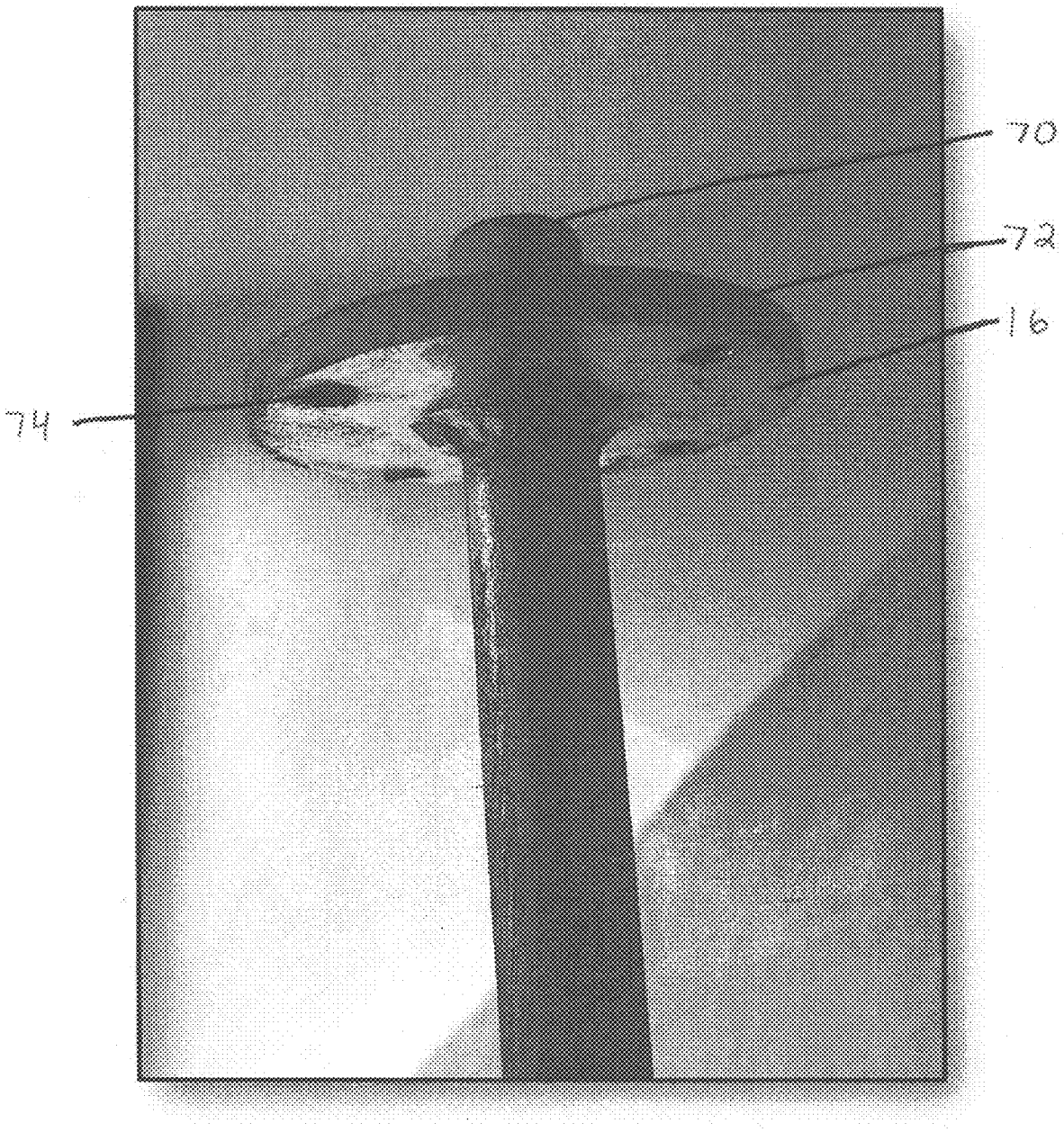
FIG. 3 is a perspective view the terminal end of the first end portion of the embodiment of FIG. 1 in detail.
Figure 4:
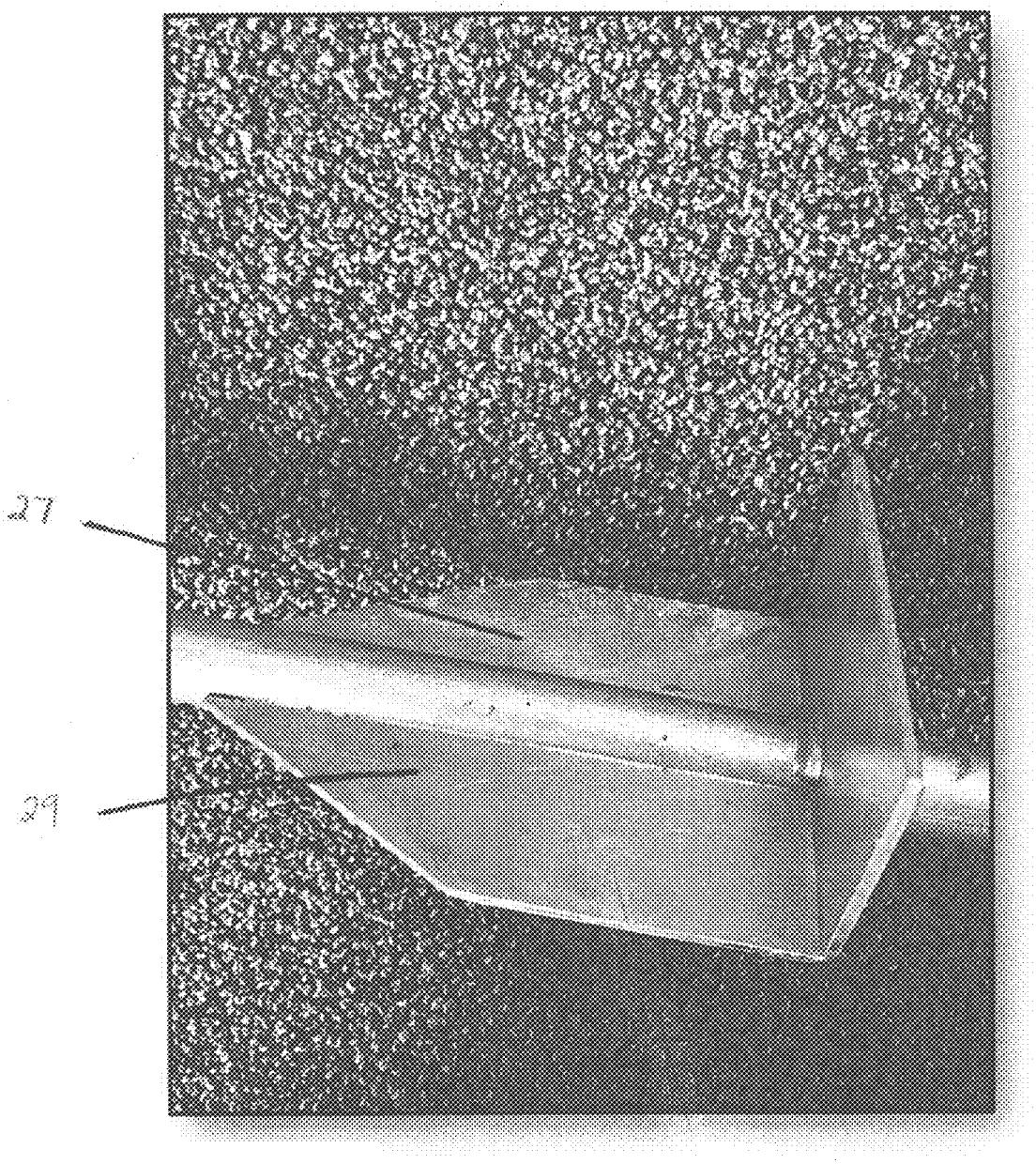
FIG. 4 is a perspective view of the anti-twist device of the embodiment of FIG. 1 in detail.
Figure 6:
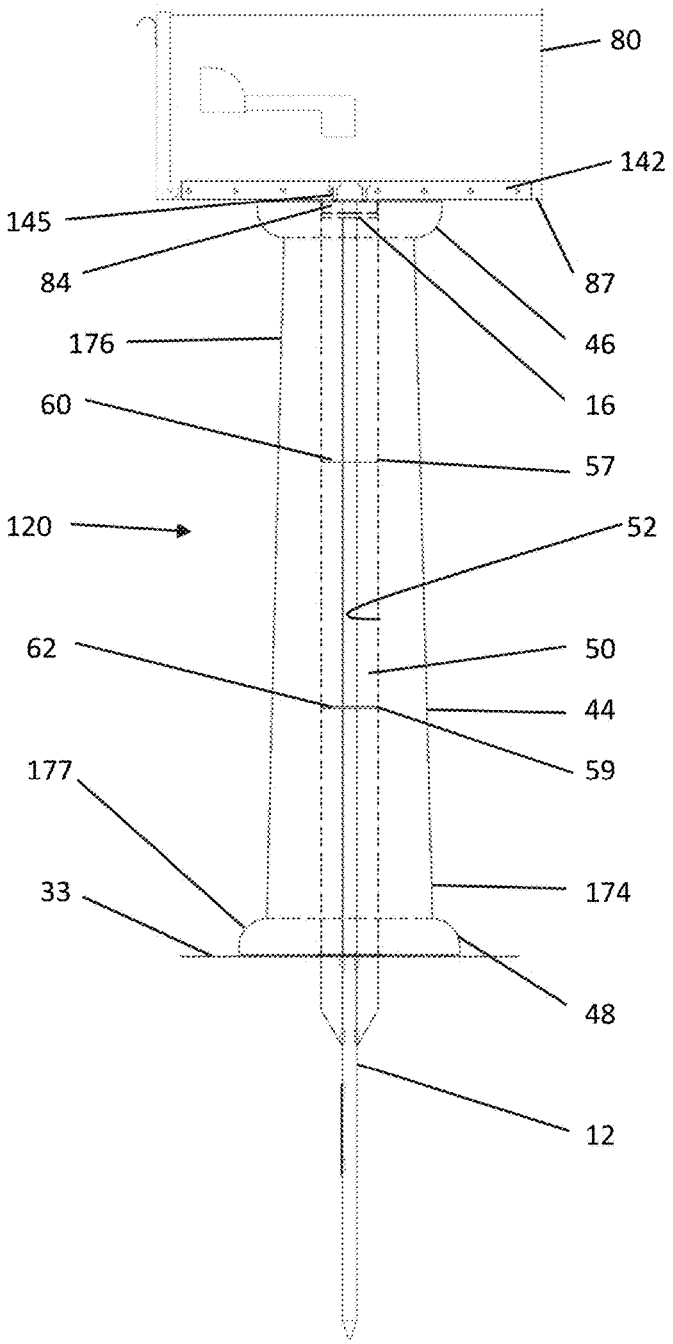
FIG. 6 shows the embodiment of FIG. 1 in a right side elevational view when installed in a system that is connected to the top component.
Figure 7:
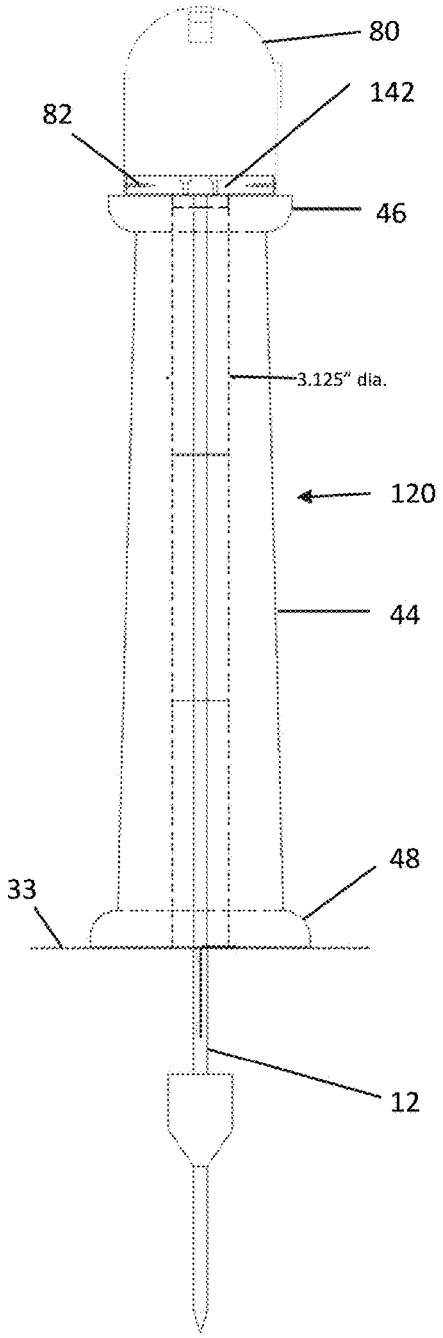
FIG. 7 shows the embodiment of FIG. 1 in a front end elevational view when installed in a system that is connected to the top component.
Figure 8:
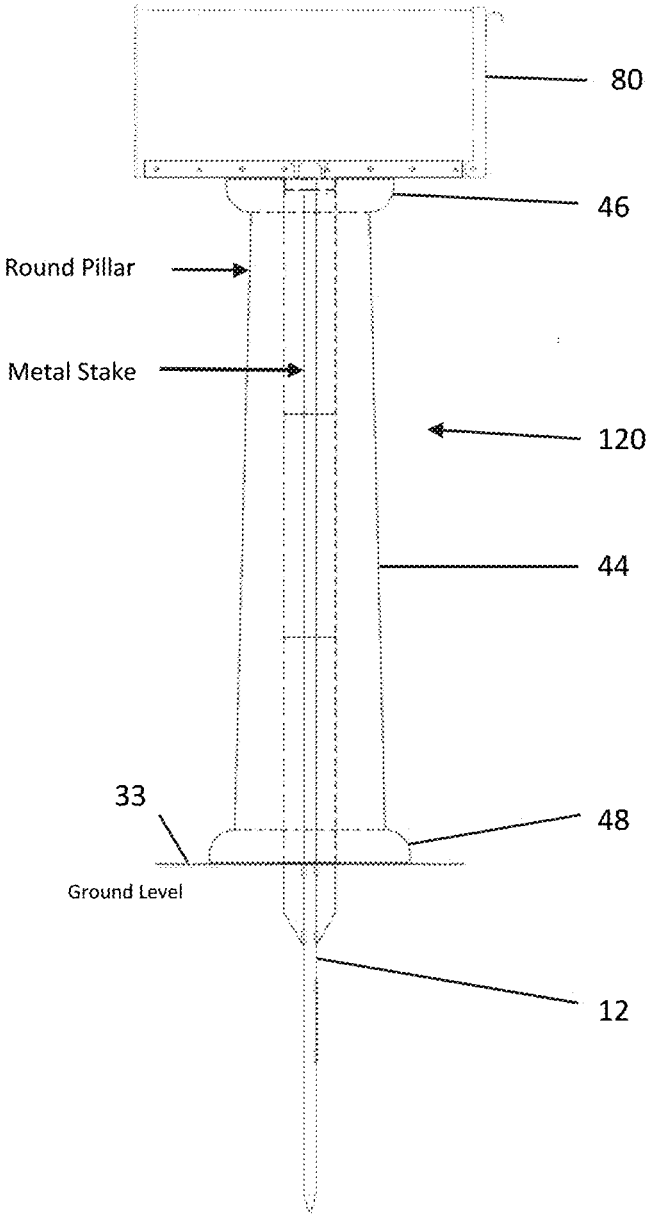
FIG. 8 shows the embodiment of FIG. 1 in a left side view with the stabilizing component displayed when installed in a system that is connected to the top component.

Details of the mounting component 16 of the apparatus 10 are shown in FIG. 3. The mounting component 16 is formed on the stake 12 at or near the terminal end 70 of the first end portion 14. In the embodiment shown in FIG. 3, the mounting component 16 is shaped as a plate. The mounting component 16 has a first surface 72 configured to directly contact a fixture 80, shown in FIG. 5, such as a mail box, sign, etc., or directly contact a connecting plate 142 for the item 74, as is shown in FIGS. 6-8. In the embodiment shown in FIGS. 6-8, the connecting plate 142 is positioned between the first surface 72 and the item 24. The mounting component 16 has a plurality of bores 74 extending in a direction perpendicular to the plane of the first surface 72 configured to receive bolts, screws, or another suitable type of fastener, described below in detail.

FIGS. 6-8 show various views of a system 120 that includes a support apparatus 10, a shell 44, and a mailbox or other supported fixture 80. In the embodiment shown in FIGS. 6-8, the connecting plate 142 is positioned between the mounting component 16 and the supported fixture 80. The connecting plate 142 is configured to receive a plurality of fasteners 82 that connect the plate 142 to the fixture 80. The fasteners 82 extend through bores 122 in the fixture 80. The fixture sits on top of the shell 44. The connecting plate 142 also is configured of receive a plurality of fasteners 84 that connect the plate 142 to the mounting component 16, such as screws. The fasteners extend through bores 145 in plate 142 and through bores 74 in mounting component 16.

Figure 9:
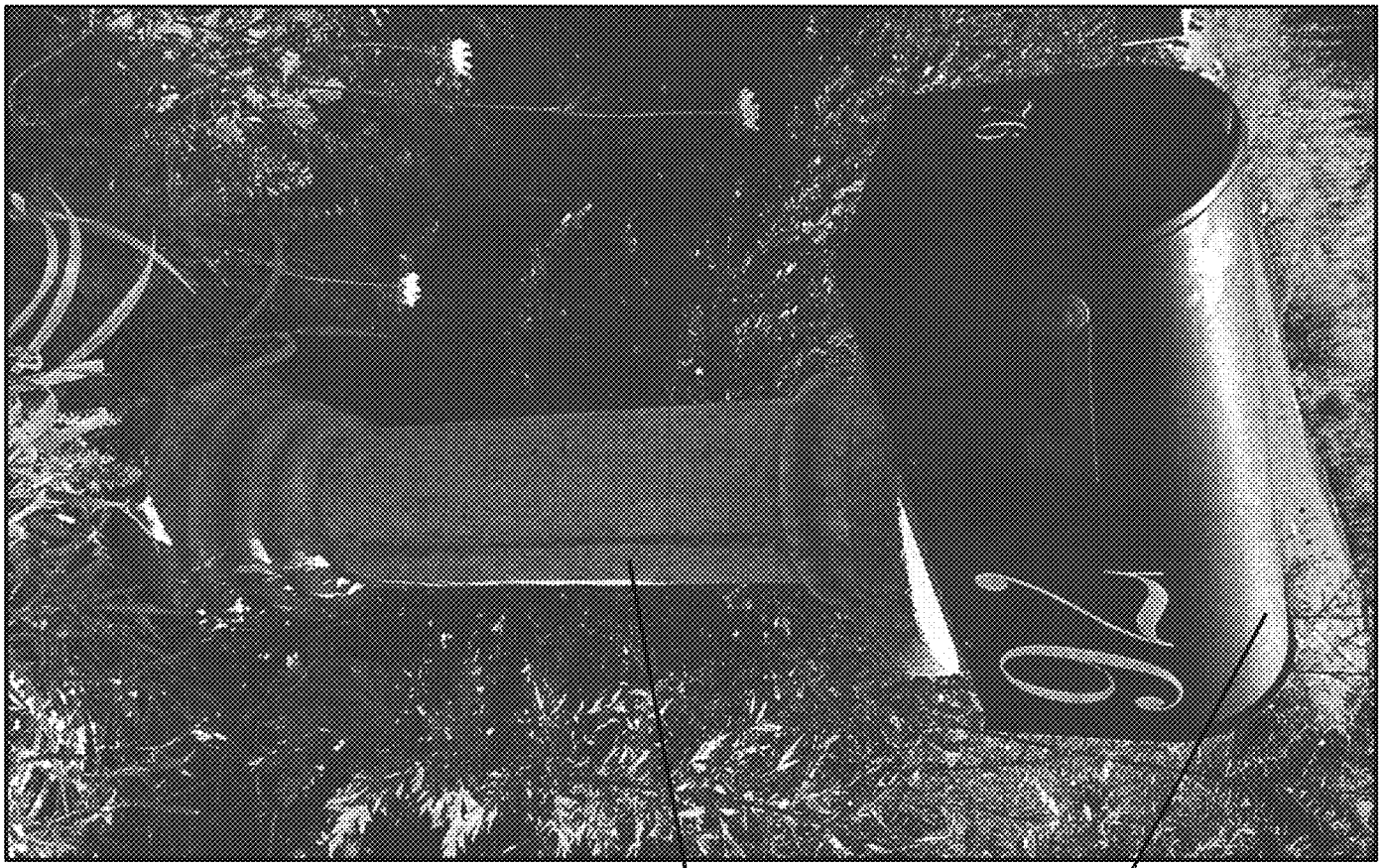
FIG. 9 shows the embodiment of FIG. 1 when employed in a system.

FIG. 9 is a photo showing an embodiment with a shell 244 around an internal support apparatus (not shown). The internal support apparatus has a configuration similar that that shown in FIGS. 1-6. The shell 244 is made from concrete or a concrete-looking substance, although other materials also can be used. A receptacle 180 is mounted to the top of the shell 244.

Figure 10:
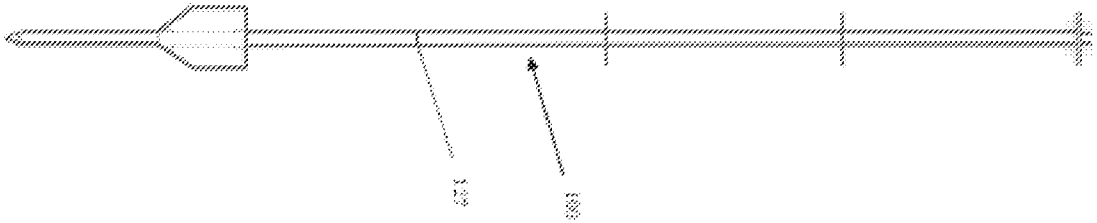
FIG. 10 shows an elevational view of a second embodiment of the support apparatus.

FIG. 10 shows a second embodiment 100. This embodiment does not contain a stabilizing component and includes an indicia 127 that informs the installer of the stake how far into the ground it should be pushed.

Figure 11:
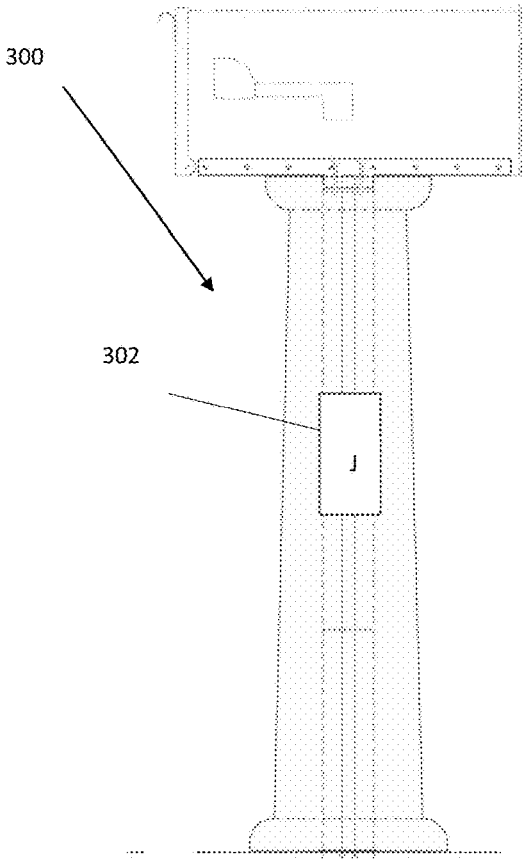
FIG. 11 shows a side view of the shell component as part of a system according to a third embodiment.

FIG. 11 shows a side view of the shell component as part of a system 300 according to a third embodiment. The system 300 shows a mounted support 302 that includes an affixed inscription "J." In embodiments, the mounted support 302 is a plaque, sign, plate, decoration, card, picture, shelf, or panel.

Figure 12:
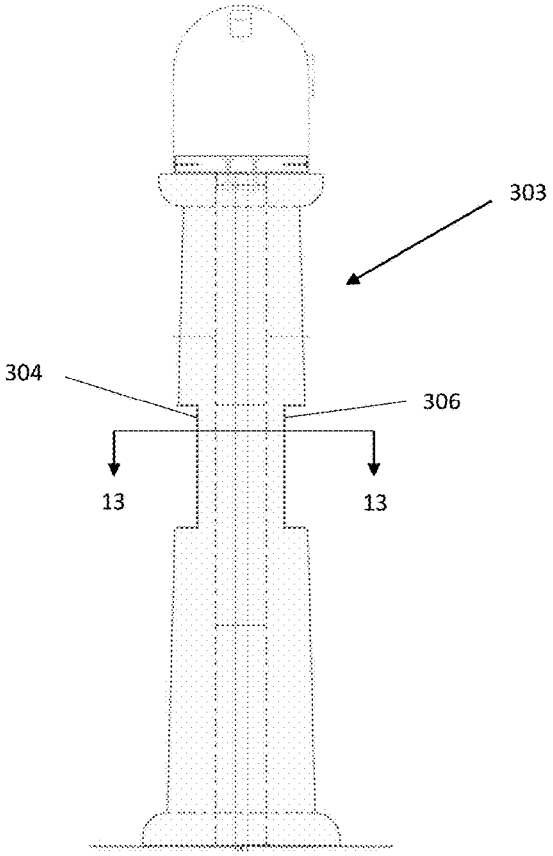
FIG. 12 shows a front view of the shell component as part of a system according to a fourth embodiment.
Figure 13:
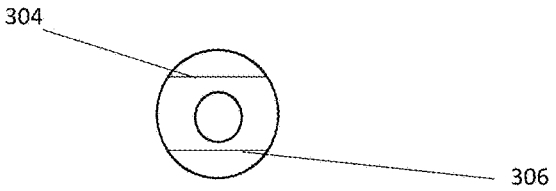
FIG. 13 shows a cross-sectional view of the inscription affixing area of the fourth embodiment.

FIGS. 12 and 13 show a fourth embodiment. In FIG. 12, the system 303 includes two inscription affixing sections 304 and 306. The inscription affixing sections 304 and 306 are configured as two opposite indentations that are configured to receive two inscription supports. FIG. 13 shows a cross sectional view of the inscription affixing sections 304 and 306 where opposing indentations are shown.

Figure 14:
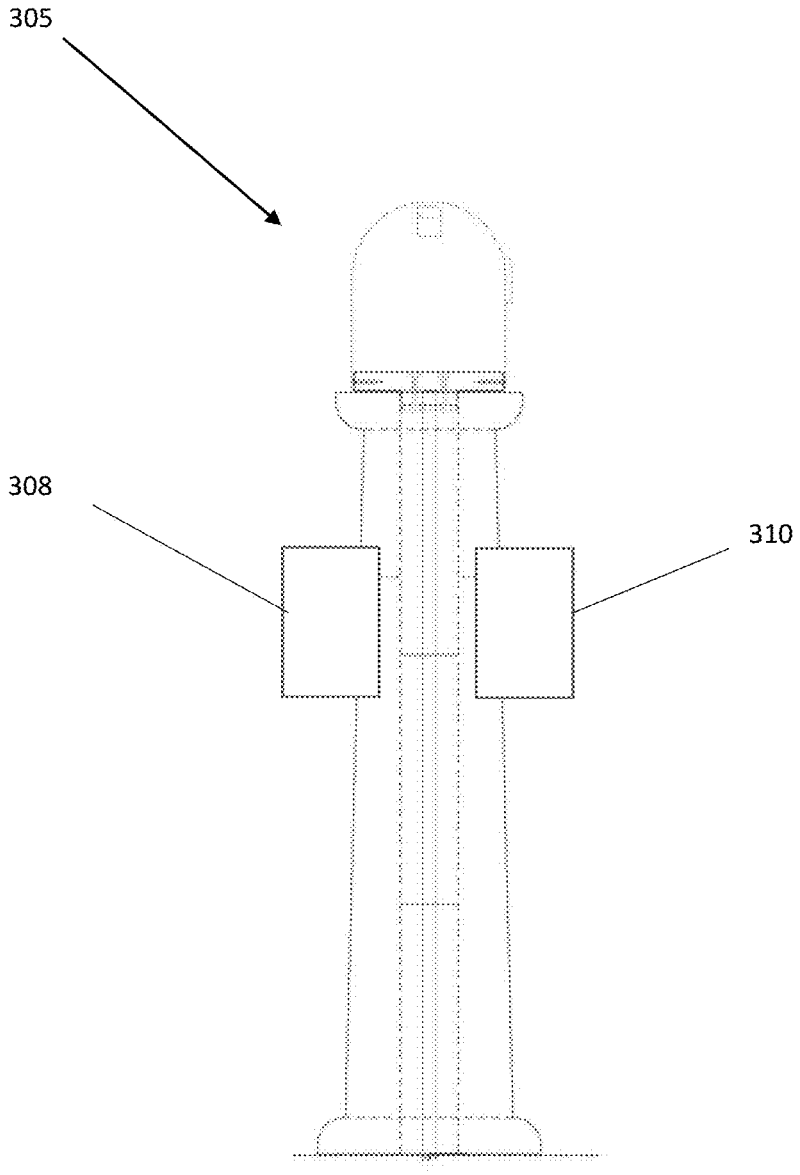
FIG. 14 shows a front view of the shell component as part of a system according to a fifth embodiment.

FIG. 14 shows a fifth embodiment, which is a system 305 including protruding inscription-affixing sections 308 and 310. Protruding inscription-affixing section 308 is on one side of the shell while protruding inscription-affixing section 310 is on the opposite side. A support 302 can be mounted on the protruding inscription-affixing section 308 (and/or 310) to display an inscription that is formed on the support 302, or an inscription can be formed directly on the outer surface of the protruding inscription-affixing section 308 (and/or 310).

In some embodiments, including the embodiment of FIGS. 6-8, an inscription can formed on any suitable surface of the shell. In certain embodiments, a support can be mounted using a mounting device, such as a hook or nail, that is affixed to the shell in a manner similar to the manner in which a picture is mounted on a wall.

In some embodiments, the shape and density of the shell impart additional stability or anti-tipping properties to the support apparatus. In the embodiment shown in FIGS. 6-8, the shell 44. is wider at the lower end 174 and that the upper end 176. The lower end further includes a base 177 that protrudes radially to further prevent sideways movement of the support apparatus 10. In some cases, a high-density material is used for the shell in order to further promote the stability of the system 120.

In embodiments, the support apparatus 10 has a length in the range of about 3 feet to about 11 feet, or about 4 feet to about 8 feet, or about 4 feet to about 6 feet. The shell 44 has a length of about 2 feet to about 8 feet, or about 2 to about 6 feet, or about 3 feet to about 5 feet. In embodiments, the lower end 174 of the shell 44 has a width of about 6 inches to about 18 inches, or about 10 inches to about 14 inches, and the upper end 176 of the shell 44 has width of about 3 inches to about 14 inches, or about 6 inches to about 12 inches.

In the embodiment shown in FIG. 6-8, the bottom surface 87 of the supported fixture 80 is connected to the support apparatus 10, but none of the side surfaces of the supported fixture 80 are directly connected to the support apparatus.

In embodiments, the support apparatus may be formed from a natural or synthetic substance, and typically is formed from a metal, or a heavy-duty thermoset or thermoplastic material that may include one or more fillers. In embodiments shells may be formed from natural or synthetic substances, including wood, metal, plaster, cement, marble, granite, stone, thermoplastic materials, thermoset materials, and composites, including thermoplastics and thermoset containing fillers.

In some cases, the top component is a receptacle, such as a mail box. In some cases, the top component is a sign or yard accessory.

The support apparatus can be made by welding or otherwise fixing the various components to an elongated post. In embodiments, the support apparatus can be molded or 3D printed as a unitary component, or a portion of the support apparatus can be molded or 3D printed and additional components can subsequently be attached thereto.

A number of alternatives, modifications, variations, or improvements therein may be subsequently made by those skilled in the art, which are also intended to be encompassed by the following claims.

What is claimed is:

1. A system comprising:

a stake with a first end portion configured to be positioned above a ground surface and to support a top component disposed above the stake, and a second end portion configured to be positioned at least partially underground, an anti-twist device formed on the second end portion, a stabilizing component formed on the second end portion between the anti-twist device and the first end portion, and a shell with a length and a longitudinal opening configured to receive at least a part of the first end portion of the stake, the shell having a first end, and a second end opposite the first end that is configured to contact a surface of the ground when the system is in use, wherein the stake extends through the entire length of the shell.

2. The system of claim 1, further comprising a top component configured to be connected to a terminal end of the first end portion of the stake, the top component comprising at least one member selected from the group consisting of a mailbox, sign, windmill, tent, statue, fountain, bird bath, and display stand.

3. The system of claim 1, wherein the shell is configured as a column, post, or pole.

4. The system of claim 3, wherein the shell has a length of 2 feet to 8 feet.

5. The system of claim 3, wherein the shell comprises at least one of wood, plaster, cement, marble, granite, metal, and stone.

6. The system of claim 3, wherein a top component is mounted to the top of the shell.

7. The system of claim 3, wherein the shell comprises at least one of a thermoplastic material and a thermoset material.

8. The system of claim 7, wherein the thermoplastic material and/or thermoset material contains a filler.

9. The system of claim 1, wherein the stabilizing component includes a first section that extends radially outwardly from the stake.

10. The system of claim 9, wherein the anti-twist device includes coplanar first and second fins extending radially outwardly from the stake, and the first section of the stabilizing component is generally planar and includes first and second blades orientated generally perpendicularly relative to the plane of the first and second fins of the anti-twist device.

11. The system of claim 9, wherein the stabilizing component includes a generally planar second section that is perpendicular to an axis of the stake and is configured to be positioned on the surface of the ground when the apparatus is in use.

12. The system of claim 1, wherein the shell includes an inscription-affixing section.

13. The system of claim 12, wherein the inscription-affixing section includes an indentation, protrusion, or flat surface on the shell.

14. The system of claim 12, wherein the inscription-affixing section has an inscription formed directly on the shell.

15. The system of claim 12, wherein the inscription-affixing section is configured to receive a support that includes an inscription.

16. The system of claim 15, wherein the support includes a plaque, sign, plate, decoration, card, picture, shelf, or panel.

17. The system of claim 1, wherein the shell has a length that is generally equivalent to the length of the first portion of the stake.

18. A system comprising:

a stake with a first end portion configured to be positioned above a ground surface and to support a top component, and a second end portion configured to be positioned at least partially underground, an anti-twist device formed on the second end portion, a stabilizing component formed on the second end portion between the anti-twist device and the first end portion, and a shell with a length and a longitudinal opening configured to receive at least a part of the first end portion of the stake, the shell having a first end, and a second end opposite the first end that is configured to contact a surface of the ground when the system is in use, the shell having an inscription-affixing section configured to receive an inscription, wherein the stake extends through the entire length of the shell.

19. The system of claim 18, wherein the inscription is displayed on a support mounted to the inscription-affixing section.

20. The system of claim 18, wherein the shell comprises at least one of wood, plaster, cement, marble, granite, metal, and stone.

* * * * *